US005417329A

United States Patent [19]

Whitman

[11] Patent Number: 5,417,329

[45] Date of Patent: May 23, 1995

[54] VERTICAL STORAGE AND DISPENSING MEANS

[76] Inventor: Robert S. Whitman, 2714 Northview Rd., Philadelphia, Pa. 19152

[21] Appl. No.: 314,611

[22] Filed: Sep. 28, 1994

Related U.S. Application Data

[63] Continuation of Ser. No. 124,363, Sep. 20, 1993, abandoned, which is a continuation of Ser. No. 754,572, Sep. 4, 1991, abandoned.

[51] Int. Cl.[6] ..... B65D 21/00

[52] U.S. Cl. ..... 206/499; 206/493; 206/503; 206/504; 206/509; 220/4.27; 220/23.83; 211/74

[58] Field of Search ..... 206/493, 499, 503, 504, 206/509; 220/23.83, 23.6, 4.26, 4.27; 211/49.1, 59.2, 74, 113, 194

[56] References Cited

U.S. PATENT DOCUMENTS

| | | | |
|---|---|---|---|
| 911,785 | 2/1909 | Vasconcelles | 220/4.27 |
| 1,065,633 | 6/1913 | Stone | 220/4.27 |
| 1,560,938 | 11/1925 | Lund | 206/493 X |
| 1,562,196 | 11/1925 | Abrams | 206/493 X |
| 1,944,075 | 1/1934 | Gaisman | 206/499 X |
| 2,826,333 | 3/1958 | Rodemich | 206/509 X |
| 3,180,489 | 4/1965 | McGinn | 206/499 X |
| 3,719,272 | 3/1973 | Bodine et al. | 220/23.83 X |
| 3,819,847 | 6/1974 | Charles | 206/509 X |
| 4,000,841 | 1/1977 | Bachli | 206/509 |
| 4,025,212 | 5/1977 | Block | 206/509 X |
| 4,327,836 | 5/1982 | Okumo | 211/74 |
| 4,428,145 | 1/1984 | Wheeler | 220/4.27 X |
| 4,616,752 | 10/1986 | Ridgley | 220/4.27 X |
| 4,688,684 | 8/1987 | Young et al. | 211/74 X |
| 5,076,430 | 12/1991 | Philpot | 220/23.83 X |

FOREIGN PATENT DOCUMENTS

| | | | |
|---|---|---|---|
| 0101346 | 6/1965 | Denmark | 220/4.27 |
| 390113 | 3/1933 | United Kingdom | 206/493 |
| 846541 | 8/1960 | United Kingdom | 206/509 |
| 1146029 | 3/1969 | United Kingdom | 206/509 |

*Primary Examiner*—Allan N. Shoap
*Assistant Examiner*—Stephen Cronin

[57] ABSTRACT

A storage and dispensing device having a plurality of individual storage and dispensing compartments is provided. Each compartment is provided with a slidable mating opening through a wall of the compartment for slidably mating with an extending track. The compartments are adapted to be grasped and slidably moved along the track to separate the compartments and permit access to compartments opened thereby. The compartments are slidably returned to a non-separated position in which the wall of one compartment serves as a closure element for an adjacent compartment. The track may be an upstanding vertical rod requiring upward horizontal separation of the compartments in order to gain access. A plurality of these compartments, each having a mating opening for sliding along the extending track, act cooperatively to prevent jamming or sticking of the compartments as they slide along the track together. The compartments are rotatable with respect to each other and rotatable in unison around the track. Additionally, the entire device may be suspended with a wire and rotated using the wire.

4 Claims, 1 Drawing Sheet

VERTICAL STORAGE AND DISPENSING MEANS

This application is a continuation of application Ser. No. 08/124,363 filed Sep. 20, 1993, now abandoned, which is a continuation of application Ser. No. 07/754,572 filed Sep. 4, 1991, now abandoned.

BACKGROUND OF THE INVENTION

1) Field of the Invention

This invention relates to the field of storage devices and in particular to the field of vertically stackable nested storage devices.

2) Background Art

In many applications it is useful to easily gain access to differing materials stored in differing vertically stacked storage compartments of a storage device. It is known in the prior art to provide vertically stacked storage compartments for storing materials wherein the storage compartments are not slidably movable. When storage compartments of this type are not slidably movable, one-handed separation of the compartments to permit access to the materials with the free hand is difficult. Such devices are taught by U.S. Pat. No. 3,719,272, issued to Bodine, on Mar. 6, 1973, U.S. Pat. No. 3,819,847, issued to Charles, on Jun. 25, 1974, and U.S. Pat. No. 4,025,212, issued to Block, on May 24, 1977. However, since these storage devices do not permit easy one-handed opening of compartments or removal of materials from within compartments, they do not provide the type convenient dispensing of the material which is required in many applications.

It is also known in the prior art to provide slidably openable stacked storage compartments adapted to permit more convenient dispensing of materials. For example, U.S. Pat. No. 2,826,333 issued to Rodemich, on Mar. 11, 1958, teaches a vertical frame and a series of combined closure and supporting members which slide on the frame for supporting and closing stacked removable containers. In the storage system of Rodemich a combined closure and supporting member between stacked containers may be grasped and slidably moved upward to permit access to a removable container beneath it.

However, the frame and the closure elements of Rodemich protrude outwardly beyond the edges of the containers, thereby wasting horizontal space wherein no materials may be stored. Additionally, because the supporting members slide along three horizontally spaced apart tie rods, care must be taken when sliding one of the members upward to keep the member level in order to prevent sticking and jamming of the member against the rods. It is therefore difficult to gain access to the contents of the containers using only one hand since two hands are required to reliably keep the combined closure and supporting member level. Additionally, when removing the contents from the containers it is possible to inadvertently remove and spill a removable container because the containers are not secured to the frame in the storage system taught by Rodemich.

U.S. Pat. No. 911,785, issued to Vasconcelles, on Feb. 9, 1909, also teaches vertically stacked containers. The apparatus of Vasconcelles is also provided with external rods forming a bale for stacking the containers. However, the containers are not adapted to permit easy one-handed access to materials inside the containers since there is provided no means for gripping a container to lift it above the container disposed below it.

Furthermore, Vasconcelles teaches a lid on each container wherein the lid prevents easy one-handed access to a container. In order to hold the containers within the stacking bale and to adapt the containers to be slidable along the rods of the bale, both the containers and the lids are provided with notches for receiving the rods. The notches prevent the containers from rotating with respect to each other to permit easy access to materials on all sides of the interior of each container.

U.S. Pat. No. 4,000,841, issued to Bachli, on Jan. 4, 1977, teaches stacked trays which may serve as compartments for storing material. However, the stacked trays of Bachli cannot be easily separated for gaining access to materials inside the trays with one hand because they slide along two posts. The trays are thus subject to sticking and jamming as they slide along the posts. Therefore, two hands are required to reliably separate the trays taught by Bachli. Additionally, the posts of Bachli are exterior to the storage space thereby causing wasted space in the vicinity of the storage compartments.

Therefore, it is an object of the invention to provide vertically stacked storage compartments which may be easily separated to permit one-handed removal of materials from inside the compartments.

It is a further object of the invention to provide a storage device having vertically stacked storage compartments which are not removable from the device in order to prevent the compartments from falling out of the device during use.

SUMMARY OF THE INVENTION

A storage and dispensing device having a plurality of individual storage and dispensing compartments is provided. Each individual compartment is provided with a mating opening through at least one wall of the compartment for mating with an extending track. The compartments are adapted to be grasped and slidably moved along the track to separate the compartments and permit access to compartments opened thereby. The compartments are slidably returned to a non-separated position in which a wall of one compartment serves as a closure element for an adjacent compartment.

DETAILED DESCRIPTION OF THE INVENTION

Figure 1:
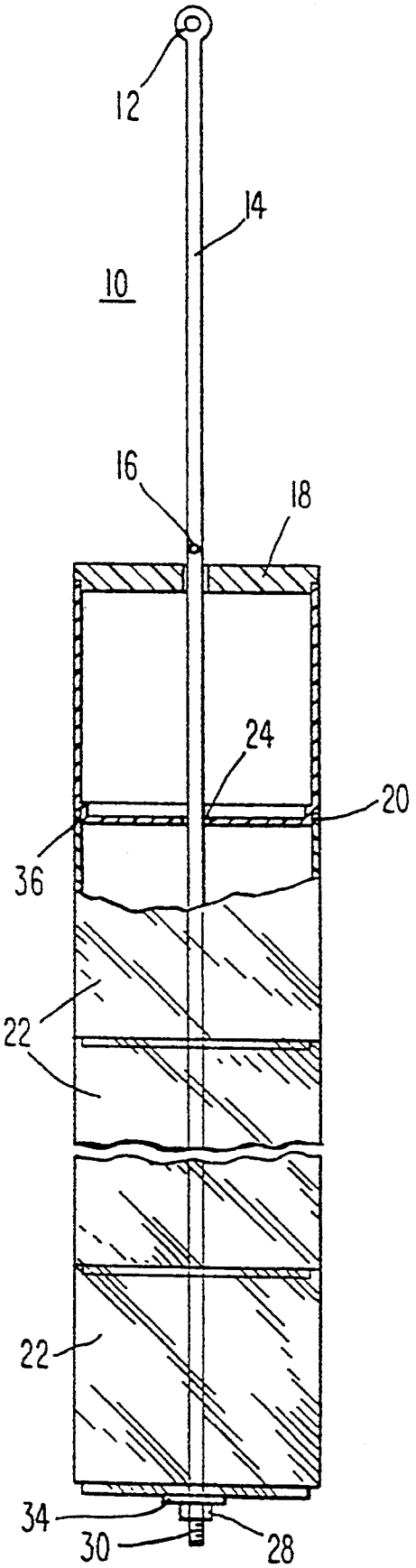
FIG. 1 shows a cross-sectional representation of one alternate embodiment of the vertical storage and a dispensing device of the present invention.
Figure 2:
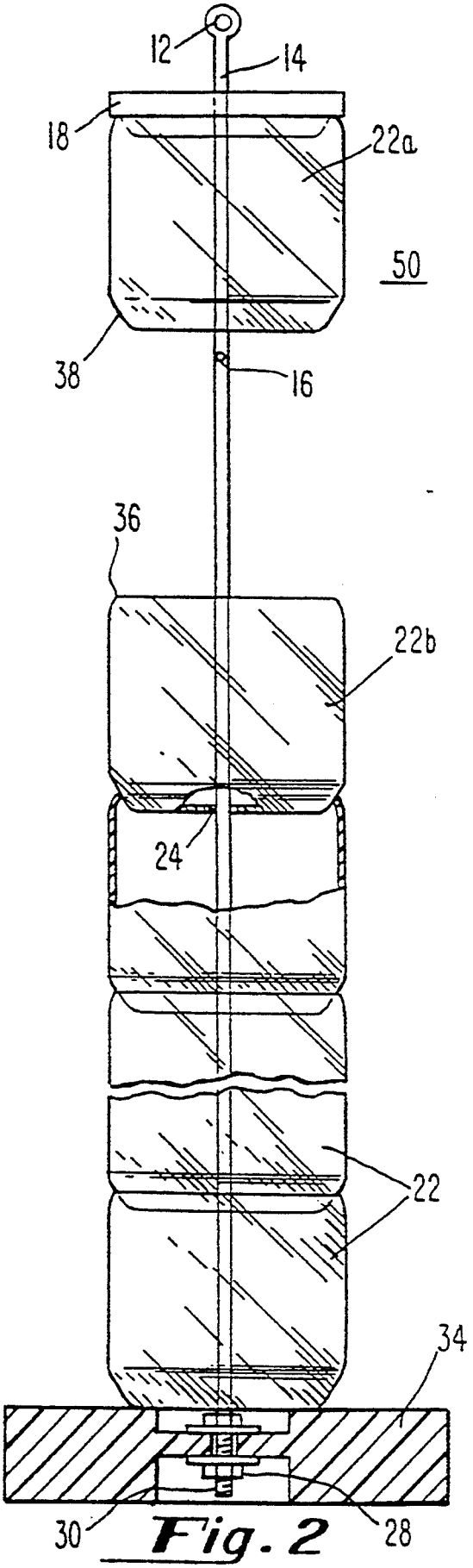
FIG. 2 shows a cross-sectional representation of another alternate embodiment of the vertical storage and dispensing device of FIG. 1.

Referring now to FIGS. 1, 2 there are shown vertical storage and dispensing devices 10, 50 of the present invention. Standing vertical storage and dispensing device 50 and suspendable vertical storage and dispensing device 10 are two possible alternate embodiments of the present invention. Vertical storage and dispensing devices 10, 50 include a plurality of slidably separatable storage and dispensing compartments 22 for storing and dispensing materials (not shown) within compartments 22. Storage and dispensing compartments 22 are adapted to be nestingly stacked upon each other. Compartments 22 are also slidably and rotatably mated with upright metal rod 14 which serves as a track for compartments 22 when compartments 22 are slidably separated from each other.

Access to materials within an individual slidable storage compartment 22*b* may be obtained by one-handed slidable lifting of storage compartment 22*a* immediately above storage compartment 22*b* in order to open storage compartment 22*b*. Storage compartment 22*a* is slidably lifted far enough to substantially separate storage compartments 22*a,b*. A free hand may then be moved through the space between slidably separated storage compartments 22*a* ,b and inserted into storage compartment 22*a* to remove the stored materials.

Thus stored materials may be conveniently dispensed from within storage and dispensing compartment 22*a* using one hand to uncover the stored materials and one hand to remove them. To close compartment 22*a* after access and protect the materials within compartment 22*a* during further storage, compartment 22*b* is slidably lowered along upright metal rod 14 Until compartment 22*a* nestingly rests upon compartment 22*b*. When compartment 22*a* rests upon compartment 22*b* the bottom of compartment 22*a* serves as a closure element for compartment 22*b*. It will be understood that access to storage compartments 22 of both device 10 and device 50 may be obtained as described for compartments 22*a,b*.

It will therefore be understood that each storage and dispensing compartment 22 within vertical storage and dispensing devices 10, 50 may serve as both a storage compartment 22 for storing materials and a dispensing compartment 22 for later dispensing the stored materials. Additionally, it will be understood that each storage compartment 22 of devices 10, 50 may provide closure for storage compartment 22 disposed below it.

As previously described, slidably openable storage and dispensing compartments 22 within storage and dispensing devices 10, 50 are adapted to nest with each other. To permit nesting of compartments 22 within storage and dispensing device 10, annular nesting notch 20 is provided around the lower region of the sidewall of storage compartments 22. Annular nesting notch 20 of an upper compartment 22 receives upper lip edge 36 of a lower compartment 22 disposed below it. When annular nesting notch 20 at the bottom of upper storage and dispensing compartment 22 engages upper lip edge 36 of lower storage compartment 22 disposed below it, the two engaged storage and dispensing compartments 22, or nested storage compartments 22, are free to rotate with respect to each other around upright metal rod 14.

Thus it will be understood that annular nesting notches 20 and upper lip edges 36 provide rotatable nesting of compartments 22 within device 10. It will also be understood that it is in this nested relationship that the bottom wall of upper storage and dispensing compartment 22 serves as a closure element for lower storage and dispensing compartment 22 disposed beneath it within devices 10.

To permit nesting of compartments 22 within storage and dispensing device 50, narrowed bottom portions 38 of device 50 are provided in the lower region of compartments 22. Narrowed portion 38 of an upper compartment 22 within device 50 is received by upper lip edge 36 of a lower compartment 22 disposed below it. When narrowed portion 38 at the bottom of upper storage and dispensing compartment 22 is engaged by upper lip edge 36 of lower storage compartment 22 disposed below it, the two engaged storage compartments 22, or nested storage compartments 22, are free to rotate with respect to each other around upright metal rod 14.

Thus it will be understood that narrowed lower portion 38 and upper lip edges 36 provide rotatable nesting of compartments 22 within device 50. It will be understood that it is in this nested relationship that the bottom wall of upper storage and dispensing compartment 22 serves as a closure element for lower storage and dispensing compartment 22 disclosed beneath it within device 50.

Upright metal rod 14 or extending tracking rod 14 is formed long enough to accommodate the required number of stacked storage and dispensing compartments 22 within vertical storage and dispensing devices 10, 50. Each storage and dispensing compartment 22 mated with upright metal rod 14 is provided with central mating opening 24 through the center of its bottom. Central mating opening 24 of compartments 22 permits stackable, slidable and rotatable mating of compartments 22 with upright metal rod 14. The diameter of central mating opening 24 through the bottom of compartment 22 is selected to be slightly larger than the diameter of upright metal rod 14 or extending track 14 with which it is mated. Thus the entire stack of compartments 22 mated with rod 14 may rotate in unison.

Because central mating opening 24 is disposed in the center of the bottom of storage and dispensing compartment 22, the weight of a plurality of stacked compartments 22 and the materials therein may be evenly distributed around supporting upright rod 14. This makes it easier to raise storage compartments 22 along upright rod 14 with a single hand to slidably separate storage compartments 22 and gain access without sticking or jamming along upright rod 14. Additionally, the use of a single upright rod 14 for tracking compartments 22, rather than a plurality of upright rods, helps prevent sticking and jamming of compartments 22 in devices 10, 50.

Further assisting easy one-handed vertical separation of storage and dispensing compartments 22 is the cooperative action of a plurality of central mating openings 24 through the bottoms of a plurality of nested compartments 22 which are lifted simultaneously. Each compartment 22 of this plurality of simultaneously lifted compartments 22 is tracked and straightened by the cooperation of the plurality of tracking openings 24 and upright rod 14.

In the preferred embodiment of vertical storage and dispensing device 10, eye loop 12 may be attached to the upper end of upright metal rod 14 for vertically attaching storage and dispensing device 10 to an overhanging feature. In this manner, storage and dispensing device 10 may be free hanging and not in contact with any surfaces. If device 10 is suspended by means of a wire (not shown) attached to eye loop 12, the entire structure of device 10 may be easily rotated to easily gain access to materials in all regions of compartments 22.

It will be understood that the rotation of the entire structure of suspended storage and dispensing device 10 is distinguished from rotation of individual storage and dispensing compartments 22 with respect to each other within device 10. Additionally, individual compartments 22 may be rotated relative to each other around upright rod 14 during rotation of the entire structure of device 10 suspended by a wire whether rotating compartments 22 are separated or nested. Furthermore, it will be understood that, notwithstanding these types of rotation, stacked compartments 22 may rotate in unison with each other around upright rod 14.

As previously described, standing vertical storage and dispensing device 50 is an alternate embodiment of suspendable vertical storage and dispensing device 10. Standing alternate embodiment 50 is provided with stand 34 or base 34 for permitting standing vertical storage and dispensing device 50 to be disposed upon a horizontal surface (not shown). Stand 34 is attached to the bottom end of upright metal rod 14. The attachment of stand 4 to upright metal 14 may be accomplished by means of machine screw nut 28 which is threadably mated with threaded portion 30 of upright metal rod 14 after stand 34 is mounted upon threaded portion 30 of upright metal rod 14. However, it will be understood that any manner of attaching stand 34 and upright rod 14 may be used. Stand 34 or base 34 should be of sufficient size and weight to permit standing vertical storage and dispensing device 50 to be stable when disposed upon a horizontal surface.

As previously described, access to materials within slidably separatable storage and dispensing compartment **22*b* of vertical storage and dispensing devices 10, 50 is gained by grasping upper storage and dispensing compartment 22*a* immediately above lower storage and dispensing compartment 22*b* into which access is required. Thus the sides of compartment 22*a,b* are adapted to serve as a gripping device during the separation of compartments 22*a,b*, although compartment 22*b* need not be grasped when it is accessed. Furthermore upper storage compartment 22*a* is adapted to be grasped with one hand by a user of devices 10, Grasped upper storage compartment 22*a* and the entire stack (not shown) of storage compartments 22 above grasped upper storage compartment 22*a* may then be slidably raised along upright metal rod 14**.

It will be understood that extending track 14 may extend in a horizontal direction and that access to compartment **22*b* may be provided by slidably separating compartments 22*a,b* in a horizontal direction along track 14. In this horizontal embodiment, slidable return closure may be provided resiliently or by force from the user, and the wall through which track 14 passes still serves as a closure element and compartments 22*a,b*** may be secured in a non-separated position by a detente device (not shown).

As also described previously, this stack of slidably raised storage compartments 22, along with grasped storage compartment **22*a*, is raised a sufficient distance to permit materials contained within lower storage compartment 22*b* to be accessed with the free hand of the user. Because storage compartment 22*b* is mated with upright metal rod 14 passing through central mating opening 24 of compartment 22*b*, there is no danger of inadvertently removing or tipping over compartment 22*b*** while removing material from it.

After the dispensing of materials within dispensing compartment **22*b*, grasped storage compartment 22*a* and the stack of storage compartments 22 above it are released. The force of gravity causes them to slidably fall along upright metal rod 14. When they come to rest, upper storage compartment 22 is guided into a nested relationship with lower storage compartment 22 by the-cooperative action of annular nesting notch 20 of upper compartment 22 and upper lip edge 36 of lower compartment 22 within device 10. Within device 50, narrowed bottom portion 38 is guided into a nested relationship with upper lip edge 36. This nesting closes lower storage compartment 22 to prevent loss of materials from lower storage compartment 22. Also, the nested closure of storage and dispensing compartments 22 protects materials within storage compartments 22 from dust and moisture. To achieve this closing, the bottom of upper compartment 22 serves a closure element for lower compartment 22**.

Cover lid 18 of vertical storage and dispensing devices 10, 50 provides closure of topmost storage and dispensing compartment 22. Upright metal rod 14, which passes through the center of cover lid 18, may be provided with horizontal bore 16 through rod 14 immediately above cover lid 18. Horizontal bore 16 through upright metal rod 14 may be adapted for inserting the shank of a small lock (not shown) therethrough in order to block slidable vertical movement of cover lid 18 along upright metal rod 14. Preventing movement of cover lid 18 in this manner prevents separation of storage and dispensing compartments 22 within storage and dispensing device 10, 50 to prevent unauthorized removal of materials from storage compartments 22 within devices 10, 50.

While this invention has been described with respect to a specific and particularly preferred embodiments thereof, it is not limited thereto and the appended claims are intended to be construed to encompass not only the specific forms and variants of the inventions shown but also such other forms and variants as may be devised by those skilled in the art without departing from the true spirit and scope of this invention.

I claim:

1. A storage and dispensing device comprising:

a plurality of stackable storage compartments and an extending track rod extending through said storage compartments for retaining said compartments in a vertically oriented stacked and unstacked position;

said extending track rod comprising, a vertically extending metal cylindrical rod with a given length and a given diameter terminating in an upper end with an annular eye loop and a lower end with a screw threaded portion, a horizontally extending base attached to said lower end by a fastener having a screw threaded portion corresponding to said lower end screw threaded portion, and a horizontal bore extending through said cylindrical rod at a point between said upper and lower ends;

each of said plurality of storage compartments comprising a horizontally extending bottom wall having a perimeter and a central housing opening with a diameter slightly greater than said cylindrical rod given diameter, a vertically extending side wall with a lower end integrally formed with said perimeter of said bottom wall and an upper end terminating in an upper lip edge to define an open upper end, and an annular notch formed at the juncture of said bottom wall perimeter and said side wall lower end;

said annular notch of a first of said plurality of storage compartments sized to receive said upper lip edge of a second of said plurality of storage compartments when said first compartment is stacked onto said second compartment, thereby enclosing said second compartment;

said plurality of compartments are stacked one upon the other with the uppermost storage compartment being enclosed by a horizontal cover lid having a central opening with a diameter identical to said central housing opening and a perimeter sized to engage the upper lip edge of said side wall, said cylindrical rod extending through said lid opening and each of said central housing openings with said bottom wall of the lowermost container resting on said base, the given length of said cylindrical rod sized to receive said plurality of compartments and said cover lid in the stacked position and to allow said lid and said uppermost storage compartment to be grasped by a user and moved upwardly along said cylindrical rod to a position which allows complete access to the interior of the storage compartment adjacent said uppermost storage compartment, thereby, allowing each of said plurality of compartments, in turn, to be grasped by a user and moved upwardly to allow access to the compartment below it, said horizontal bore positioned in said cylindrical rod at a point above said stacked storage compartments and said lid and sized to receive a lock to prevent said storage compartments and said lid from being moved upwardly until said lock is removed, and said upper eye loop allowing the storage and dispensing device to be vertically suspended.

2. The storage and dispensing device of claim 1, wherein said base is sized to allow said device to be placed on a horizontal surface when not suspended by said eye loop.

3. A storage and dispensing device comprising:

a plurality of stackable storage compartments and an extending track rod extending through said storage compartments for retaining said compartments in a vertically oriented stacked and unstacked position;

said extending track rod comprising, a vertically extending metal cylindrical rod with a given length and a given diameter terminating in an upper end with an annular eye loop and a lower end with a screw threaded portion, a horizontally extending base attached to said lower end by a fastener having a screw threaded portion corresponding to said lower end screw threaded portion, and a horizontal bore extending through said cylindrical rod at a point between said upper and lower ends;

each of said plurality of storage compartments comprising a horizontally extending bottom wall having a perimeter and a central housing opening with a diameter slightly greater than said cylindrical rod given diameter, a vertically extending side wall with a lower end integrally formed with said perimeter of said bottom wall and an upper end terminating in an inwardly and upwardly extending upper lip edge to define an open upper end, and a downwardly and inwardly extending truncated cone shaped narrowed bottom portion formed at the juncture of said bottom wall perimeter and said side wall lower end;

said narrowed bottom portion of a first of said plurality of storage compartments sized to receive said upper lip edge of a second of said plurality of storage compartments when said first compartment is stacked onto said second compartment, thereby enclosing said second compartment;

said plurality of compartments are stacked one upon the other with the uppermost storage compartment being enclosed by a horizontal cover lid having a central opening with a diameter identical to said central housing opening and a perimeter sized to engage the upper lip edge of said side wall, said cylindrical rod extending through said lid opening and each of said central housing openings with said bottom wall of the lowermost container resting on said base, the given length of said cylindrical rod sized to receive said plurality of compartments and said cover lid in the stacked position and to allow said lid and said uppermost storage compartment to be grasped by a user and moved upwardly along said cylindrical rod to a position which allows complete access to the interior of the storage compartment adjacent said uppermost storage compartment, thereby, allowing each of said plurality of compartments, in turn, to be grasped by a user and moved upwardly to allow access to the compartment below it, said horizontal bore positioned in said cylindrical rod at a point above said stacked storage compartments and said lid and sized to receive a lock to prevent said storage compartments and said lid from being moved upwardly until said lock is removed, and said upper eye loop allowing the storage and dispensing device to be vertically suspended.

4. The storage and dispensing device of claim 3, wherein said base is sized to allow said device to be placed on a horizontal surface when not suspended by said eye loop.

* * * * *